US011638954B2

(12) United States Patent
Sibiet

(10) Patent No.: US 11,638,954 B2
(45) Date of Patent: May 2, 2023

(54) BOTTOM PLATE ASSEMBLY COMPRISING A BAYONET FREE COLLECTOR NOZZLE

(71) Applicant: VESUVIUS GROUP, S.A., Ghlin (BE)

(72) Inventor: Fabrice Sibiet, Collert (FR)

(73) Assignee: VESUVIUS GROUP, S.A., Ghlin (BE)

( * ) Notice: Subject to any disclaimer, the term of this patent is extended or adjusted under 35 U.S.C. 154(b) by 227 days.

(21) Appl. No.: 16/762,699

(22) PCT Filed: Nov. 9, 2018

(86) PCT No.: PCT/EP2018/080829
§ 371 (c)(1),
(2) Date: May 8, 2020

(87) PCT Pub. No.: WO2019/092214
PCT Pub. Date: May 16, 2019

(65) Prior Publication Data

US 2020/0360991 A1 Nov. 19, 2020

(30) Foreign Application Priority Data

Nov. 10, 2017 (EP) ..... 17200984

(51) Int. Cl.
*B22D 41/50* (2006.01)
*B22D 41/28* (2006.01)
*B22D 41/56* (2006.01)

(52) U.S. Cl.
CPC ..... *B22D 41/502* (2013.01); *B22D 41/28* (2013.01); *B22D 41/56* (2013.01)

(58) Field of Classification Search
CPC ..... B22D 41/502; B22D 41/28; B22D 41/56
See application file for complete search history.

(56) References Cited

U.S. PATENT DOCUMENTS

| | | | | |
|---|---|---|---|---|
| 4,480,771 | A * | 11/1984 | Meier | B22D 41/26 222/548 |
| 4,887,748 | A | 12/1989 | Hicks | |
| 5,052,598 | A | 10/1991 | King et al. | |
| 5,062,554 | A * | 11/1991 | Sakai | B22D 41/28 222/606 |
| 5,174,908 | A | 12/1992 | King et al. | |
| 8,939,331 | B2 | 1/2015 | Ackermann | |
| 9,174,277 | B2 | 11/2015 | Collura | |
| 9,452,477 | B2 | 9/2016 | Mauch | |
| 10,052,687 | B2 | 8/2018 | Quinn et al. | |
| 10,464,129 | B2 | 11/2019 | Collura | |

(Continued)

FOREIGN PATENT DOCUMENTS

| | | | |
|---|---|---|---|
| CN | 2369802 | Y | 3/2000 |
| CN | 201070668 | Y | 6/2008 |
| CN | 201361708 | Y | 12/2009 |

(Continued)

*Primary Examiner* — Scott R Kastler
(74) *Attorney, Agent, or Firm* — MaxGoLaw PLLC

(57) ABSTRACT

A gate for metallurgic vessels is provided with a collector nozzle coupled to a bottom plate assembly of the gate. The bottom plate assembly allows a collector nozzle to be coupled to a bottom gate plate without need of a separate bayonet ring. A bayonet ring is integrated to the bottom plate assembly, allowing a collector nozzle to be mounted by a single robot, or by a single operator more easily than existing systems.

16 Claims, 7 Drawing Sheets

(56) References Cited

U.S. PATENT DOCUMENTS

2020/0360991 A1* 11/2020 Sibiet ..... B22D 41/50

FOREIGN PATENT DOCUMENTS

| | | | |
|---|---|---|---|
| CN | 204603288 | U | 9/2015 |
| DE | 102004008382 | A1 | 9/2005 |
| JP | 553119412 | U | 9/1978 |
| JP | 3050043 | U1 | 5/1991 |
| JP | 2005211905 | B | 10/2009 |
| KR | 20070115419 | A | 12/2007 |
| RU | 2055691 | C1 | 3/1996 |
| RU | 2567419 | C2 | 9/2013 |
| WO | 2006067038 | A1 | 6/2006 |
| WO | 14170103 | A1 | 10/2014 |
| WO | 2015124567 | A1 | 8/2015 |

* cited by examiner

BOTTOM PLATE ASSEMBLY COMPRISING A BAYONET FREE COLLECTOR NOZZLE

CROSS-REFERENCE TO RELATED APPLICATIONS

This application is a U.S. national stage application, filed under 35 U.S.C. § 371, of International Application No. PCT/EP2018/080829, which was filed on Nov. 9, 2018, and which claims priority from European Patent Application No. EP17200984.7, which was filed on Nov. 10, 2017, the contents of each of which are incorporated by reference into this specification.

BACKGROUND OF THE INVENTION

(1) Field of the Invention

The present invention relates to a novel bottom plate assembly for coupling a collector nozzle to a mechanism attached to a bottom of a metallurgic vessel, such as a ladle or a tundish, requiring neither an additional bayonet ring to be inserted over the collector nozzle, nor any rotation of the collector nozzle. This way, an operator needs handling a collector nozzle only. The present invention also allows the coupling of a collector nozzle to a mechanism attached to a bottom of the metallurgic vessel by a simple robot. As no rotation of the collector nozzle is required for securing the collector nozzle in place, a thin layer of sealing material can be used to seal the collector nozzle in place, without disrupting it by shear strain.

(2) Description of the Related Art

In metal forming processes, molten metal (1) is transferred from one metallurgic vessel (200L, 200T) to another, to a mould (300) or to a tool for ingots. For example, as shown in FIGS. 1A and 1B a ladle (200L) is filled with molten metal out of a furnace (not shown) and transferred through a ladle shroud (111) into a tundish (200T) for casting. The molten metal can then be cast through a pouring nozzle (101) from the tundish to a mould (300) for forming slabs, billets, beams or ingots or directly from a ladle to a tool for ingots. Flow of molten metal out of a metallurgic vessel is driven by gravity through a nozzle system (101, 111) located at the bottom of said vessel. The flow rate can be controlled by a gate and/or a stopper.

In particular, the inner surface of the bottom floor of a ladle (200L) is provided with an inner nozzle (100) comprising an inner bore. The outlet end of said inner nozzle is coupled to a gate, generally a sliding plate gate or a rotating plate gate, controlling the flow rate of molten metal out of the ladle. In such gates, a fixed plate provided with a bore is fixed to an outer surface of the ladle bottom floor with the bore positioned in registry with the inner nozzle's bore. A sliding or rotating plate, also provided with a bore can move such as to bring the bore in or out of registry with the bore of the fixed plate, thus controlling the flow rate of molten metal out of the ladle. The sliding or rotating plate is coupled either to a collector nozzle, or to a bottom fixed plate, itself coupled to a collector nozzle. In order to protect the molten metal from oxidation as it flows from the ladle into a tundish (200T), a ladle shroud (111) is brought in fluid communication with the outlet end of the collector nozzle and penetrates deep into the tundish, below the level of molten metal to form a continuous molten metal flowpath shielded from any contact with oxygen between the inlet end of the inner nozzle within the ladle down to the outlet of the ladle shroud immersed in the liquid metal contained in the tundish. A ladle shroud is simply a nozzle comprising a long tubular portion crowned by an upstream coupling portion with a central bore. The ladle shroud is inserted about and sealed to a short collector nozzle (10) coupled to and jutting out of the outer surface of the ladle bottom floor, and which is separated from the inner nozzle (100) by a gate.

Similarly, an outlet of the bottom floor of a tundish (200T) is also provided with an inner nozzle (10) rather similar to the one described supra with respect to a ladle. The downstream surface of said inner nozzle can be coupled directly to a pouring nozzle (101) or, alternatively, to a gate or to a tube changing device. In order to protect the molten metal from oxidation as it flows from the tundish to a mould (300), the pouring nozzle (101) penetrates deep into the mould, below the level of molten metal to form a continuous molten metal flowpath shielded from any contact with oxygen between the upstream surface of the inner nozzle within the tundish down to the outlet of the pouring nozzle immersed in the liquid metal flowing into the mould. A pouring nozzle is a nozzle comprising a long tubular portion crowned by an upstream coupling portion with a central bore. A pouring nozzle can be inserted about and sealed to a short collector nozzle (10) coupled to and jutting out of the outer surface of the tundish bottom floor. For continuous casting operations, flow rate out of a tundish is generally controlled by means of a stopper (7) or the combination of a gate and a stopper. A sliding gate or rotating gate as described above can also be used for the casting of discrete ingots.

In practice, a ladle is prepared for operation including building the refractory inner liner, fixing a gate to the bottom of the ladle, positioning an inner nozzle, refractory plates and a collector nozzle. When ready for operation, the ladle is driven to a furnace where it is filled with a fresh batch of molten metal, with the gate in a closed configuration. It is then brought to its casting position over a tundish (200T), where a ladle shroud is coupled to the collector nozzle in a casting configuration, such that the outlet end of the collector nozzle (10) is snuggly nested in the bore inlet of the ladle shroud to form a sealing joint (cf. FIG. 1B). The ladle shroud can be maintained in its casting configuration by a robot, or by any other means known in the art, such as described in WO2015124567. The gate is opened, and the molten metal can flow out of the ladle into the tundish through the inner nozzle, gate, collector nozzle, and ladle shroud. When the ladle is empty, the gate is closed and the ladle shroud is retrieved to allow the removal of the empty ladle and replacement by a second ladle filled with a new batch of molten metal. The ladle and the gate refractories are first inspected for defects. Then the ladle is either sent back to the furnace for a refill of molten metal, or is sent for repair, where one or more of the refractory components (e.g., plates, collector nozzle, and inner nozzle) are replaced when required.

After a number of pouring cycles by the ladle, various components of the ladle and of the tundish can be worn off or broken and must be changed. This includes the collector nozzle.

A collector nozzle (10) is generally sealed with a sealing material to a bottom surface of the bottom gate plate (20*g*) and secured by means of a separate bayonet ring (22*b*), which is inserted over the collector nozzle and coupled to the frame by rotation thereof. This operation is quite cumbersome for an operator because he must hold the collector nozzle in position in a substantially horizontal position as the ladle is laid down on its side, and at the same time take a (heavy) bayonet, insert it over the collector nozzle and rotate it to secure it to the frame. A simple robot could hardly perform these operations as it would require two arms, one for holding the collector nozzle and one for handling the bayonet. U.S. Pat. No. 4,887,748 describes an example of bayonet-type attachment between a bottom gate plate and a nozzle that is uniformly adjustable during operation. Collector nozzles provided with an integrated bayonet have been proposed but have encountered little success, because the weight of the collector nozzle and bayonet is too high for a single operator to handle it. A robot could handle the extra weight, but if the robot is not available at a given moment, it remains very heavy for an operator.

A screw has also been proposed, wherein the collector nozzle is simply screwed in place onto the frame. The problem with a screwing thread is that the rotation of the collector nozzle may irreversibly damage the thin layer of sealing material (2) applied between the upstream surface (10*u*) of the collector nozzle and a downstream surface of the downstream gate plate. If the sealing layer is disrupted, molten metal may leak through cracks in the sealing layer during casting, which is obviously undesirable.

The present invention proposes a bottom plate assembly allowing the coupling of a collector nozzle to a frame without requiring a separate bayonet (22*b*), without increasing the weight of the collector nozzle by including the bayonet therein and requiring no rotation of the collector nozzle to securing it to the frame, thus preserving the integrity of the sealing layer sealing the collector nozzle to the downstream gate plate (20*g*). These and other advantages of the present invention are presented more in details in continuation.

SUMMARY OF THE INVENTION

The present invention is defined in the appended independent claims. Embodiments are defined in the dependent claims. In particular, the present invention concerns a bottom plate assembly comprising:

(A) A collector nozzle comprising:

An upstream surface (and a downstream surface joined to one another by a lateral surface), and comprising a bore extending along a longitudinal axis, Z, from the upstream surface to the downstream surface, N protrusions, with N≥0.2 (such as N=3 or 4) distributed, preferably evenly, around a perimeter of the lateral surface, each protrusion comprising an upper surface which is adjacent to the upstream surface of the collector nozzle and a lower surface separated from the upper surface by a height of the protrusion, and having an azimuthal width, W, measured normal to the longitudinal axis, Z, (B) A frame comprising a gate plate receiving unit for receiving a lower gate plate (20*q*), and (C) a nozzle coupling unit for receiving and rigidly coupling the collector nozzle to the frame, said nozzle coupling unit comprising a nozzle receiving bushing rigidly fixed to the frame, wherein, the nozzle coupling unit further comprises a bayonet ring comprising an upstream edge and a downstream edge separated by a height of the bayonet ring, which is permanently and rotatably mounted in the nozzle receiving bushing such that the bayonet ring can rotate about the longitudinal axis, Z, and wherein the bayonet ring comprises an inner surface provided with N channels extending along the longitudinal axis, Z, from the downstream edge to the upstream edge, wherein the N channels have a downstream width, Wd, at the level of the downstream edge which is substantially equal to, slightly larger than the width, W, of the protrusions, allowing the translation along the longitudinal axis, Z, of the collector nozzle through the downstream edge of the bayonet ring with the protrusions engaged in corresponding channels until they contact the corresponding protrusion mating structures, and wherein the N channels have an upstream width, Wu, at the level of the upstream edge which is larger than the downstream width, Wd, thus allowing the rotation of the bayonet ring about the longitudinal axis, Z, with respect to the collector nozzle until an edge of the channel contacts the lower surface of the corresponding protrusion, thus locking the collector nozzle in an operating position.

In the present document, the expressions "[Wd is] slightly larger than the width, W" indicates that the downstream width, Wd, should be sufficiently larger than W to allow the protrusions to move along the downstream end of the channels, and sufficiently narrow to guide the protrusions towards the corresponding protrusion mating structures. For allowing a movement of the protrusions along the channels, Wd can be at least 1% larger than W, preferably at least 2% larger than W. For allowing the guiding of the protrusions, Wd can be not more than 10% larger than W, or not more than 5% larger than W.

In a specific embodiment, the N channels extend from the downstream edge over at least 40% of the height of the bayonet ring with a substantially constant width, Wd, and widen until reaching the width, Wu, at the upstream edge. It is advantageous that the bayonet ring comprises an outer surface provided with a thread mating a thread provided at an inner surface of the nozzle receiving bushing, such that rotation of the bayonet ring with respect to the nozzle receiving bushing translates the bayonet ring along the longitudinal axis, Z.

The nozzle receiving bushing preferably comprises protrusion mating structures for receiving the protrusions and preventing the collector nozzle from rotating about the longitudinal axis, Z. This is useful as the rotation of bayonet ring may drive the rotation of the collector nozzle which may thus disrupt the integrity of the sealing material applied between the upstream surface of the collector nozzle and a bottom surface of the bottom gate plate. In this embodiment, the bayonet ring preferably comprises an outer surface provided with a rotation stop, and the nozzle receiving bushing preferably comprises a corresponding rotation stop provided at an inner surface of the nozzle receiving bushing, which stops rotation of the bayonet ring when the channels of the bayonet ring face the protrusion mating structures of the nozzle receiving bushing.

The nozzle receiving bushing is preferably formed of an upstream portion rigidly fixed to the frame, and of a downstream portion coupled to the upstream portion and sandwiching the bayonet ring, allowing rotation of the bayonet ring with respect to the nozzle receiving bushing, but not extraction of the bayonet ring from the nozzle receiving bushing. To facilitate rotation of the bayonet ring, it is preferred that the downstream edge of the bayonet ring comprises rotating means, including protrusions or recesses, allowing the insertion of a tool for rotating the bayonet ring about the longitudinal axis, Z.

The bottom plate assembly of the present invention can be part of a gate system mounted at a bottom of a metallurgic vessel, including a ladle, a furnace, or a tundish. The frame is part of the gate system and can either be:

A mobile carriage in a two-plate gate, or

A fixed frame in a three-plate gate.

The present invention also concerns a method for mounting a collector nozzle onto a gate system, said method comprising the following steps:

(a) Providing a bottom plate assembly as described above, (b) Engaging the upstream surface of the collector nozzle through the bayonet ring from the downstream edge, with the N protrusions engaged in the corresponding channels, (c) inserting the collector nozzle along the longitudinal axis, Z, through the bayonet ring all the way until the collector nozzle reaches an operating position, (d) rotating the bayonet ring about the longitudinal axis, Z, with respect to the collector nozzle until the collector nozzle is locked into its operating position and cannot move along the longitudinal axis, Z.

in a preferred embodiment, the bottom plate assembly comprises a nozzle receiving bushing provided with protrusion mating structures as described supra, and wherein the method further comprises the step of positioning the channels of the bayonet ring face to face with the corresponding nozzle mating structures of the nozzle receiving bushing, prior to step (c) of inserting the collector nozzle along the longitudinal axis, Z, through the bayonet ring all the way until the collector nozzle reaches its operating position with the protrusions engaged in the nozzle mating structures and thus prevented from rotating with respect to the longitudinal axis, Z.

Prior to engaging the collector nozzle through the bayonet ring in step (c), the method of the present invention may further comprise the following steps, A bottom gate plate is positioned into the gate plate receiving unit and is rigidly coupled to the frame, a refractory sealing material is applied onto the upstream surface of the collector nozzle, such that when the collector nozzle reaches its operating position in step (d), the sealing material contacts a downstream surface of the bottom gate plate.

It is advantageous that at least one, some, or advantageously all, the steps (b) to (d) of method of the present invention are carried out by a robot.

BRIEF DESCRIPTION OF THE FIGURES

For a fuller understanding of the nature of the present invention, reference is made to the following detailed description taken in conjunction with the accompanying drawings in which.

DETAILED DESCRIPTION

Figure 1:
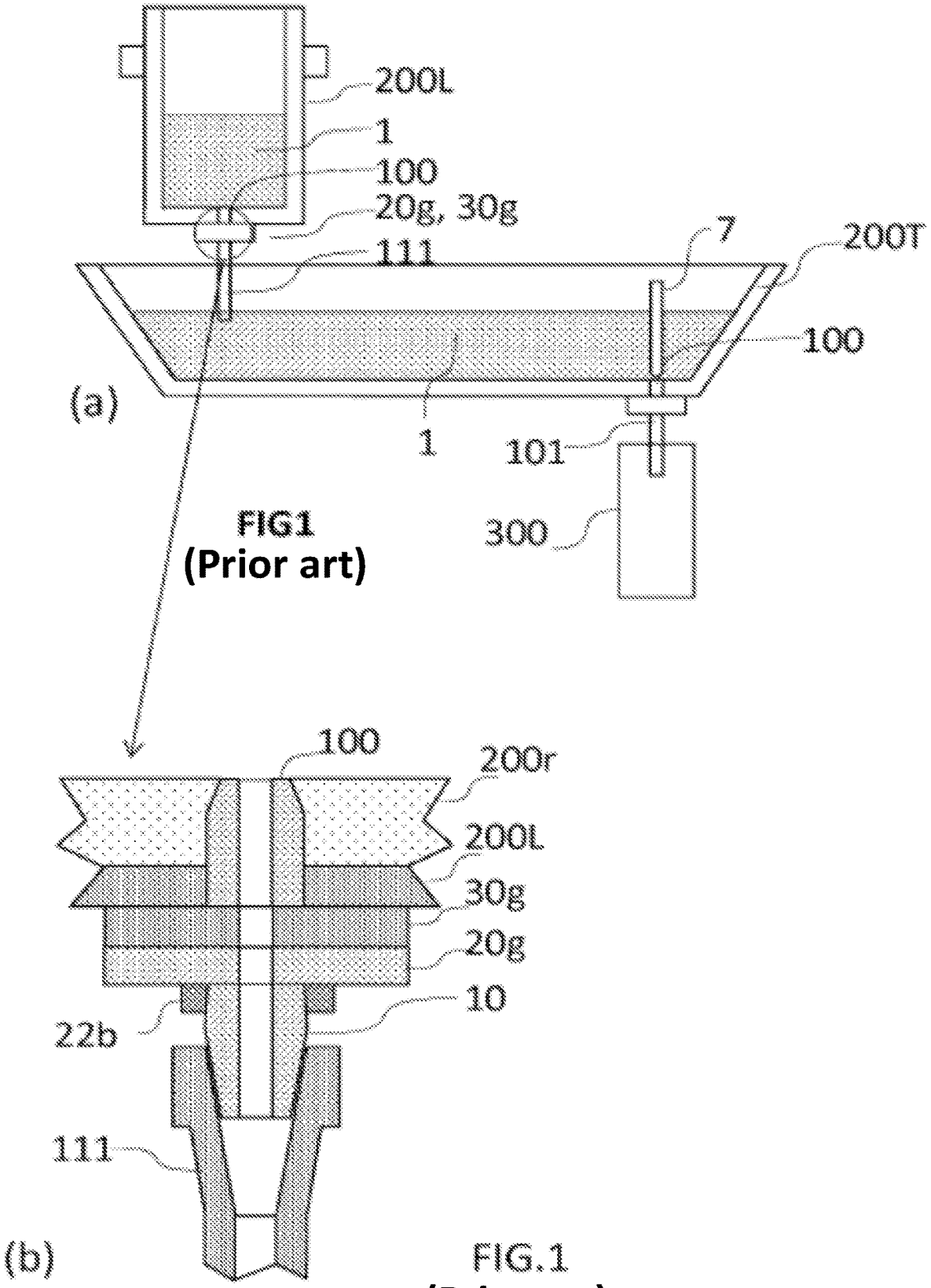
FIG1 (Prior art)
FIG.1 (Prior art)
FIGS. 1A and 1B are prior art general views of a casting installation for casting metal.

As discussed supra, FIGS. 1A and 1B show a metallurgic installation comprising a ladle (200L) containing molten metal filled from a furnace, and located above a tundish (200T), which is itself in fluid communication with a mould (300). The transfer of molten metal from the ladle to the tundish and from the tundish to the mould are carried out through corresponding nozzles: a ladle shroud (111) for the former, and a pouring nozzle (101) for the latter. Practically in all cases for ladles and in some cases for tundishes, the flow rate of metal through the corresponding nozzles is controlled by a gate comprising sliding plates (20*g*, 30*g*) bringing in and out of alignment bores provided in each plate. In continuation, the description focuses on ladles, but it is clear that the same teaching applies mutatis mutandis to tundishes and to any metallurgic vessels which are provided with a gate.

Figure 2A:
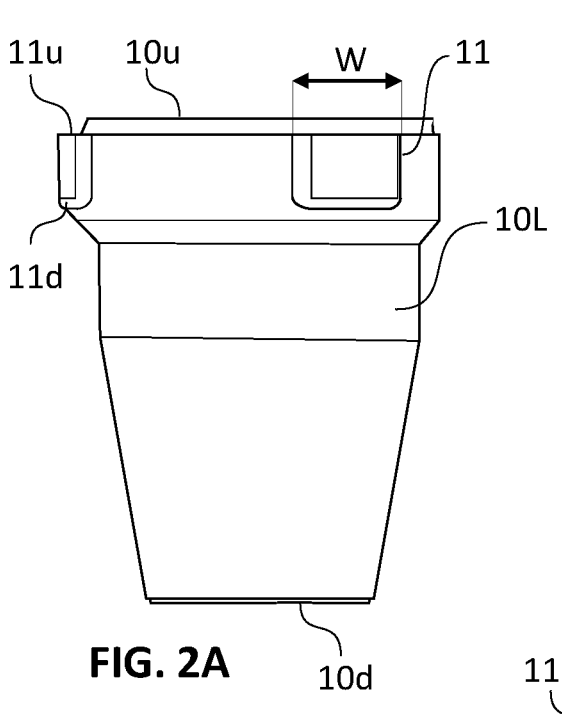
FIGS. 2A-2C show a collector nozzle as defined in the present invention.
Figure 2B:
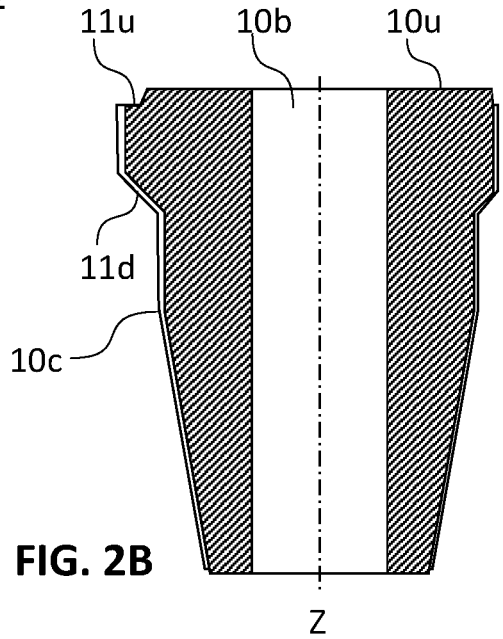
Figure 2C:
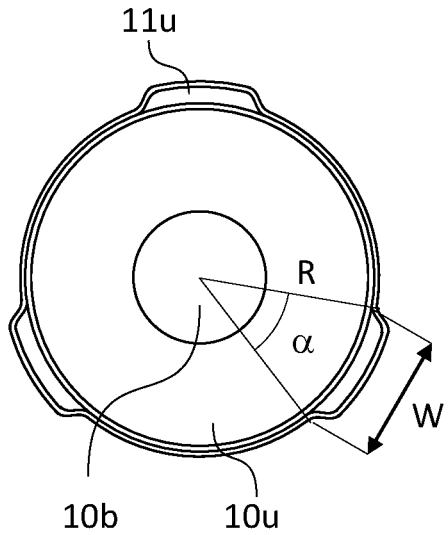

The ladle shroud (111) protects the molten metal from any contact with air as it is poured out of the ladle (200L) into the tundish (200T). It is coupled to the outlet of the ladle by means of a collector nozzle (10) over which it fits snugly (cf. FIG. 1B). As illustrated in FIGS. 2A-2C, the collector nozzle used in the present invention comprises:

(a) an upstream surface (10*u*) and a downstream surface (10*d*) joined to one another by a lateral surface (10L), and comprising a bore (10*b*) extending along a longitudinal axis, Z, from the upstream surface to the downstream surface, (b) N protrusions (11), with N≥2, distributed around a perimeter of the lateral surface, each protrusion comprising an upper surface (11*u*) which is adjacent to the upstream surface of the collector nozzle and a lower surface (11*d*) separated from the upper surface by a height of the protrusion, and having an azimuthal width, W, measured normal to the longitudinal axis, Z As illustrated in FIG. 2C, the azimuthal width, W, is herein defined as the largest width of the protrusions (11) measured normal to the longitudinal axis, Z.

The collector nozzle is coupled to the bottom outlet of the ladle with a gate sandwiched between the two. The gate comprises a bottom plate assembly comprising a frame (200 comprising a gate plate receiving unit for receiving a lower gate plate (20*g*) and provided with a nozzle coupling unit (20) for receiving and rigidly coupling the collector nozzle (10) to the frame. As shown in FIGS. 6A, 6B, 7A, and 7B, the nozzle coupling unit (20) can be fixed to the frame (200 with fixing means (3) well known to a person of ordinary skill in the art, including screws and/or bolts. The nozzle coupling unit comprises a nozzle receiving bushing (21) rigidly fixed to the frame and advantageously comprising protrusion mating structures (21*m*) for receiving the protrusions and preventing the collector nozzle from rotating about the longitudinal axis, Z. The gist of the present invention is the new design of the nozzle coupling unit combined with the mating protrusions (11) of the collector nozzle which, in combination, allow for an easier coupling and withdrawal of the collector nozzle to and from the gate.

Figure 3:
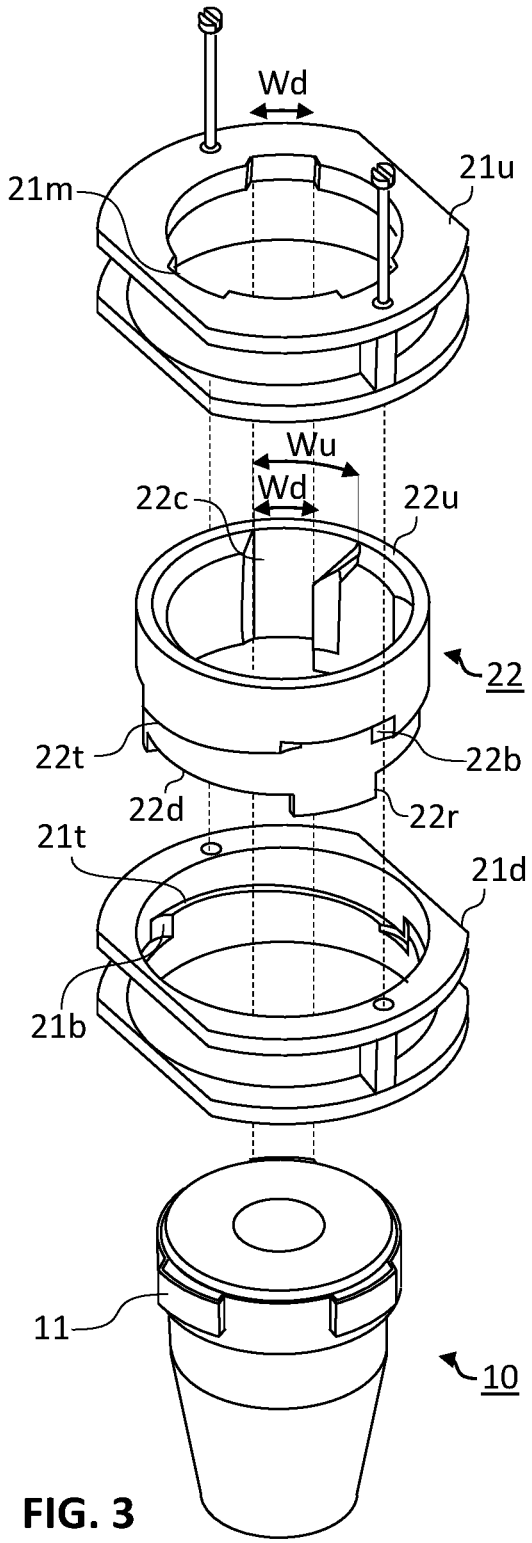
FIG. 3 shows an exploded view of the coupling elements of a bottom carriage assembly according to the present invention.
Figure 4:
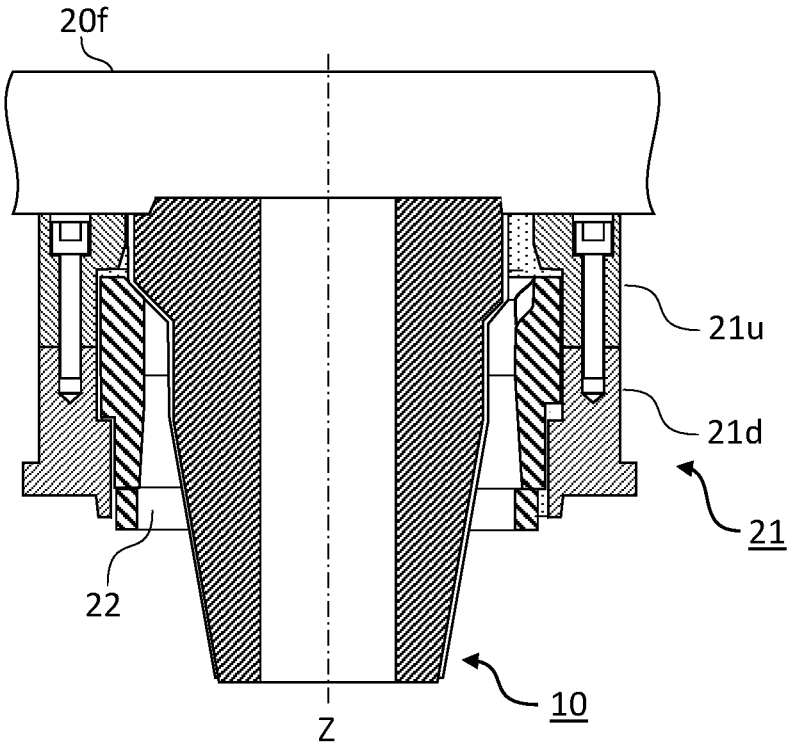
FIG. 4 shows a bottom carriage assembly according to the present invention.

As shown in FIGS. 3 and 4, the nozzle coupling unit comprises a bayonet ring (22) comprising an upstream edge (22*u*) and a downstream edge (22*d*) separated by a height of the bayonet ring, which is permanently and rotatably mounted in the nozzle receiving bushing such that the bayonet ring can rotate about the longitudinal axis, Z. The bayonet ring comprises an inner surface provided with N channels extending along the longitudinal axis, Z, from the downstream edge to the upstream edge. The N channels have a downstream width, Wd, at the level of the downstream edge which is substantially equal to, slightly larger than the width, W, of the protrusions, allowing the translation along the longitudinal axis, Z, of the collector nozzle through the downstream edge of the bayonet ring with the protrusions engaged in corresponding channels. In a preferred embodiment, the nozzle receiving bushing is provided with protrusion mating structures (21*m*). The collector nozzle can thus be translated through the bayonet ring until the protrusions engage the corresponding protrusion mating structures, thus preventing the collector nozzle from rotating about the longitudinal axis, Z. The N channels have an upstream width, Wu, at the level of the upstream edge which is larger than the downstream width, Wd, thus allowing the rotation of the bayonet ring about the collector nozzle until an edge of the channel contacts the lower surface of the corresponding protrusion, thus locking the collector nozzle in an operating position.

The nozzle coupling element of the present invention is substantially advantageous over conventional coupling systems comprising a separate bayonet which must be engaged over the collector nozzle as it is held in place by hand or by a robot, often requiring a second operator or a second robot. It is also advantageous over collecting nozzles provided with an integrated bayonet because (1) such collecting nozzles are very heavy to handle, and (2) collector nozzles, comprising a refractory portion exposed to molten metal flow, must be changed at regular intervals, whilst bayonets, made of metal and not exposed to excessive heat and wear can be re-used several times, thus unnecessarily increasing the cost of a collector nozzle.

Collector Nozzle (10)

An embodiment of collector nozzle suitable for the present invention is illustrated in FIGS. 2A-2C. As traditional collector nozzles, a collector nozzle suitable for the present invention comprises an upstream surface (10*u*) and a downstream surface (10*d*) joined to one another by a lateral surface (10L) and comprising a bore (10*b*) extending along a longitudinal axis, Z, from the upstream surface to the downstream surface. The lateral surface (10L) generally has a circular cross section, concentric with the bore. It may comprise a downstream portion tapering towards the downstream surface (10*d*), to facilitate the coupling of a ladle shroud thereto, having a tapered bore matching the geometry of the downstream portion.

The collector nozzle (10) comprises N protrusions (11), with N≥2, distributed around a perimeter of the lateral surface, and adjacent to the upstream surface (10*u*). The number, N, of protrusions is advantageously N=3 or 4. N=3 protrusions ensures a stable setting of the collector nozzle in the nozzle coupling unit and, at the same time, reduces frictions upon rotation of the bayonet. The N protrusions are advantageously distributed evenly around the perimeter of the lateral surface (10L).

The N protrusions (11) serve for securing the collector nozzle to the bottom plate assembly by interaction of the protrusions with the portion of the channels adjacent to the upstream edge of the bayonet, of upstream width, Wu. In embodiments wherein the nozzle receiving bushing comprises protrusion mating structures (21*m*), the protrusions (11) engaged in said protrusion mating structures prevent the collector nozzle from rotating. This is useful as when the bayonet ring is being rotated, the collector nozzle should not rotate together with the bayonet ring.

The N protrusions (11) have an upper surface (11*u*) and a lower surface (11*d*) separated from the upper surface by a height of the protrusion. The height of the protrusions must be sufficient for the protrusions to mechanically resist the forces applied thereto during coupling of the nozzle to the ladle and during a casting operation. For example, the height of the protrusions can be comprised between 10 and 100 mm, or between 20 and 70 mm, or between 30 and 60 mm. Similarly, the azimuthal width, W, measured normal to the longitudinal axis, Z, must be sufficient for ensuring stability of the coupling during casting operation. The azimuthal width, W, depends on the number, N, of protrusions. As illustrated in FIG. 2C, for a collector nozzle having a circular cross-section of radius, R, the azimuthal width, W=α R, wherein α is the azimuthal angle encompassing a protrusion. The azimuthal angle, α, is preferably comprised between 360°/5 N=72°/N and 360°/2 N=180°/N, preferably between 90°/N and 135°/N. For example, for N=3 protrusions, the azimuthal angle can be of the order of α=30 to 50°

The collector nozzle is made of a refractory material for resisting the high temperatures of the molten metal flowing through the bore (10*b*). The collector nozzle preferably comprises a metal can (10*c*) cladding a portion of the lateral surface (10L) comprising an upstream edge adjacent to, yet recessed from, the upstream surface (10*u*). The metal can advantageously lines at least a portion of the protrusions which interacts with the channel edges upon rotation of the bayonet ring. A portion of the downstream portion of the collector nozzle can also be clad by the metal can, to protect the refractory material from wear as a ladle shroud is engaged over the lateral surface thereof. The metal can comprises a downstream edge recessed from the downstream surface of the collector nozzle. The downstream edge can be adjacent to the downstream surface of the collector nozzle, or not. DE102004008382 describes an interchangeable metal can made of cast iron.

Nozzle Coupling Unit (20)

Figures 5A, 5B, 5C:
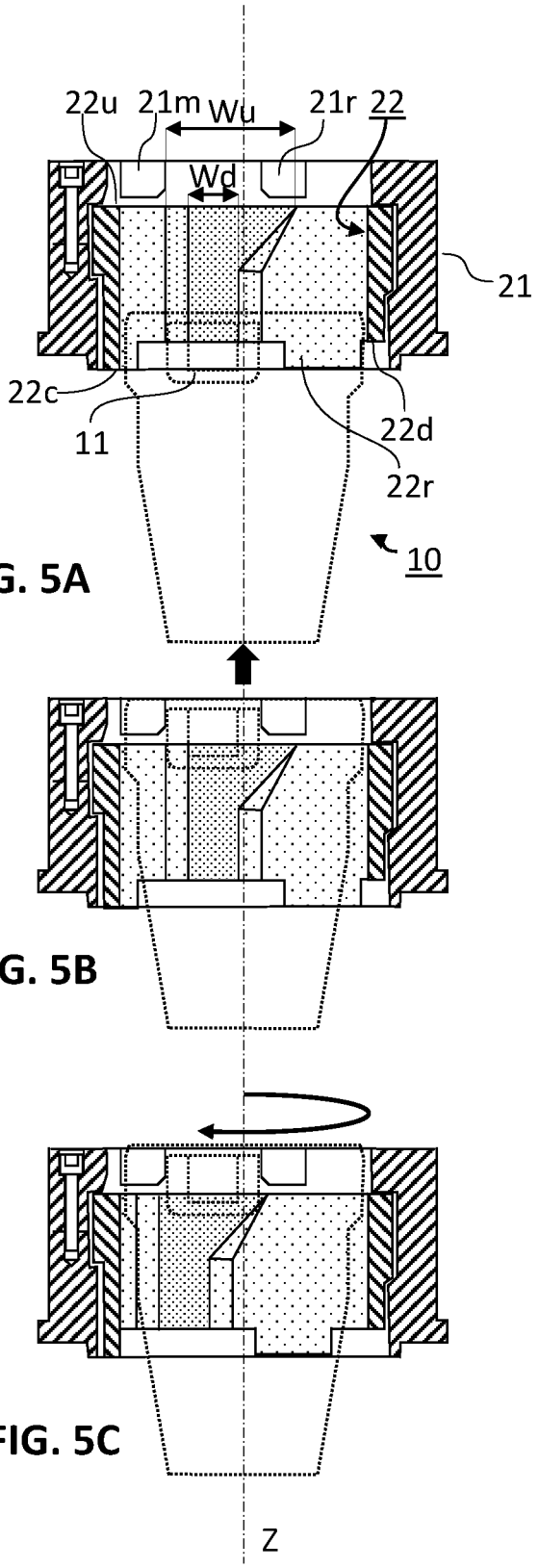
FIGS. 5A-5C illustrate the principle of coupling a collector nozzle to a bottom carriage assembly according to the present invention.

The nozzle coupling unit is used for receiving and rigidly coupling the collector nozzle (10) to the frame. It comprises a nozzle receiving bushing (21) rigidly fixed to the frame and advantageously comprises protrusion mating structures (21*m*) for receiving the protrusions and preventing the collector nozzle from rotating about the longitudinal axis, Z, when the collector nozzle has reached its operating position along the longitudinal axis, Z. The operating position of the collector nozzle along the longitudinal axis, Z, corresponds to a position wherein the upstream surface (10*u*) of the collector nozzle can be sealingly coupled to a bottom surface of a bottom plate (20*g*) of the gate, by means of a sealing material (2), with the bore (10*b*) of the collector nozzle being in registry with a bore of the bottom plate (20*g*) (cf. FIGS. 6A, 6B, 7A, and 7B). At this stage, the collector nozzle is positioned in its operating position, but it is not secured yet. The protrusion mating structures (21*m*) can be in the form of channels as illustrated in FIG. 3, of width mating the azimuthal width of the protrusions (11) and of height lower than the height of the protrusions. Alternatively, the protrusion mating structures (21*m*) can be formed by protruding members flanking on either side a protrusion when the collector nozzle is in operating position, as shown in FIGS. 5A-5C. As long as the protrusion mating structures (21*m*) prevent the collector nozzle from rotating about the longitudinal axis, Z, the present invention is not restricted by any particular geometry or design thereof. In case the nozzle receiving bushing is not equipped with protrusion mating structures (21*m*), care must be taken when rotating the bayonet ring to prevent the collector nozzle from rotating therewith.

The gist of the present invention is to permanently mount a bayonet ring (22) in the nozzle receiving bushing, such that it can rotate about the longitudinal axis. The bayonet ring comprises an upstream edge (22*u*) and a downstream edge (22*d*) separated by a height of the bayonet ring. It also comprises an inner surface provided with N channels extending along the longitudinal axis, Z, from the downstream edge to the upstream edge. The N channels have a downstream width, Wd, at the level of the downstream edge which is substantially equal to, slightly larger than the width, W, of the protrusions, allowing the translation along the longitudinal axis, Z, of the collector nozzle through the downstream edge of the bayonet ring with the protrusions engaged in corresponding channels until they contact the corresponding protrusion mating structures (21*m*). When the protrusions of the collector nozzle are engaged in the portion of channels of downstream width, Wd, the collector nozzle can be translated along the longitudinal axis, Z, but there cannot be any substantial rotation of the bayonet ring with respect to the collector nozzle.

The N channels have an upstream width, Wu, at the level of the upstream edge which is larger than the downstream width, Wd. When the protrusions are in this portion of the channels, the bayonet ring can rotate about the longitudinal axis, Z, with respect to the collector nozzle until an edge of the channel contacts the lower surface of the corresponding protrusion, thus locking the collector nozzle in an operating position.

As shown in FIGS. 3 and 5A, the channels (22*c*) of the bayonet ring can have a downstream portion of constant downstream width, Wd, followed an upstream portion flaring out progressively from the downstream width, Wd, to the upstream width, Wu, with Wu>Wd. Alternatively, the channels may abruptly pass from the downstream width, Wd, to the upstream width, Wu. A progressive transition from the downstream width, Wd, to the upstream width, Wu, is preferred because the rotation of the bayonet ring also forces the collector nozzle along the longitudinal axis, thus allowing a sealed contact with the bottom plate (20*g*) of the gate. The downstream portion of the channels (22*c*) may extend over at least 40% of the height of the bayonet ring. Advantageously the downstream portion extends over not more than 80% of the height of the bayonet ring. The upstream portion must have a height greater than the height of the protrusions of the collector nozzle, else the bayonet ring could never rotate with respect to the collector nozzle.

The channel width can increase at one side only of an axis of the channel forming an L-shaped channels, as shown in FIGS. 3 and 5A-5C, thus allowing rotation of the bayonet ring in one direction only. Alternatively, the channel width can increase symmetrically with respect to the axis of the channel, forming a T-shaped channel and allowing rotation of the ring in both directions. In the latter case, it is important to remember in which direction the bayonet ring has been rotated to secure the collector nozzle, so that it can be rotated in the right direction when retrieving a spent collector nozzle.

In an advantageous embodiment illustrated in FIG. 3, the bayonet ring comprises an outer surface provided with a thread (22*t*) mating a thread (21*t*) provided at an inner surface of the nozzle receiving bushing. This way, the rotation of the bayonet ring with respect to the nozzle receiving bushing translates the bayonet ring along the longitudinal axis, Z, and presses the collector nozzle deeper towards the bottom plate (22*g*). With this embodiment, the channel may abruptly widen from the downstream width, Wd, to the upstream width, and yet still allows pushing the collector nozzle along the longitudinal axis, Z, upon rotation of the bayonet ring.

In another advantageous embodiment, the bayonet ring comprises an outer surface provided with a rotation stop (22*b*) shown in FIG. 3; and wherein the nozzle receiving bushing comprises a corresponding rotation stop (21*b*) provided at an inner surface of the nozzle receiving bushing, which stops rotation of the bayonet ring when the channels (22*c*) of the bayonet ring face the protrusion mating structures (21*m*) of the nozzle receiving bushing. With this embodiment, the position of a collector nozzle along the longitudinal axis, Z, can be reproduced consistently and very easily, without requiring any measurement or additional tool.

As illustrated in FIG. 3, in order to facilitate rotation of the bayonet ring, it is preferred to provide the downstream edge of the bayonet ring with rotating means (22*r*), including protrusions or recesses, allowing the insertion of a tool for rotating the bayonet ring about the longitudinal axis, Z. This is very helpful for tightly securing the collector nozzle in place, and even more useful for unfastening the collector nozzle from the bayonet ring after use.

The bayonet ring (22) is part of the nozzle coupling unit and remains in place when coupling a new collector nozzle to the bottom plate assembly. In one embodiment illustrated in 3 and 4, the bayonet ring is sandwiched between an upstream portion (21*u*) and a downstream portion (21*d*) of the nozzle receiving bushing. The upstream portion (21*u*) is rigidly fixed to the frame (200, and the downstream portion (20*d*) is rigidly fixed to the upstream portion. With this construction, the bayonet ring can rotate about the longitudinal axis but cannot be removed from the nozzle coupling unit without first uncoupling the downstream portion of the bushing from the upstream portion. Alternatively, the nozzle receiving bushing can be monolithic and coupled directly to the frame (200 sandwiching the bayonet ring between the bushing and the frame.

Coupling of the Collector Nozzle to the Bottom Plate Assembly

FIGS. 5A-5C show the various steps for securing a collector nozzle to a nozzle coupling unit, and FIG. 4 shows a transverse cut of a bottom plate assembly according to the present invention, with a collector nozzle secured in its operating position. The nozzle receiving bushing of FIGS. 5A-5C is provided with nozzle mating structures (21*m*). In such embodiment, as shown in 5A, the bayonet ring must first be rotated until the channels (22*c*) of the bayonet ring are positioned face to face with the corresponding nozzle mating structures (21*m*). The upstream surface of the collector nozzle (10) is then engaged through the bayonet ring (22) from the downstream edge (22*d*), with the N protrusions engaged in the corresponding channels (22*c*). As shown in FIG. 5B, the collector nozzle is then inserted along the longitudinal axis, Z, through the bayonet ring all the way until the protrusions (11) of the collector nozzle are engaged in the protrusion mating structures (21*m*). The collector nozzle is thus prevented from rotating with respect to the longitudinal axis, Z, but at this stage, it is not secured and can slide out along the longitudinal axis, Z. Absent protrusion mating structures (21*m*) the collector nozzle is not prevented from rotating about the longitudinal axis, Z. As shown in FIG. 5C, for securing the collector nozzle, the bayonet ring is rotated with respect to the longitudinal axis, Z, engaging the upstream portion of the channels over the protrusions until they contact an edge of the channels, thus locking the collector nozzle into its operating position, which cannot move along the longitudinal axis, Z, anymore.

To optimize the locking operation, it is preferred that the geometry of the upstream portions of the channels and the portions of the protrusions which contact the channels' edges be complementary, avoiding contact areas generating excessive stress concentration, such as corners and the like. These portions of the protrusions are advantageously lined with a metal can (10*c*) lest the refractory would break upon rotating the bayonet ring too tightly.

The same operations are carried in reverse to unlock and withdraw a spent collector nozzle. The bayonet ring (22) is first rotated to unlock the collector nozzle. Advantageously this is carried out with a tool gripping the rotation gripping means or rotation gripper (22*r*) of the bayonet ring. The collector nozzle can then be pulled out along the longitudinal axis, Z, with sufficient force to disrupt the sealing material (2). The bayonet ring remains within the nozzle receiving bushing and a new collector nozzle can be mounted again as described above.

The present invention is highly advantageous in that all the foregoing operations can be carried out easily by a single operator or by a single robot. This is not the case with conventional systems comprising a separate bayonet ring, and collector nozzles provided with an integrated bayonet ring are much heavier to handle.

Two- and Three-Plate Gates

As illustrated in FIGS. 6A, 6B, 7A and 7B, the upstream surface (10*u*) of a collector nozzle is coupled to a surface of a bottom plate of a gate. A sealing contact between the two refractory surfaces is ensured by a sealing material (2). Prior to engaging the collector nozzle through the bayonet ring as discussed above, a bottom gate plate (20*g*) is positioned into the gate plate receiving unit of the frame (20*f*) and is rigidly coupled to the frame. A refractory sealing material (2) is applied onto the upstream surface (10*u*) of the collector nozzle, such that when the collector nozzle reaches its operating position with the upstream surface thereof contacting a downstream surface of the bottom gate plate, the sealing material is sandwiched between the collector nozzle and the bottom gate plate, forming a sealed contact between the two.

The bottom plate assembly of the present invention is part of a gate system which is fixed to a bottom surface of a ladle (200L) by fixing means (3) well known to a person of ordinary skill in the art, and generally including screws and/or bolts.

Figure 6A:
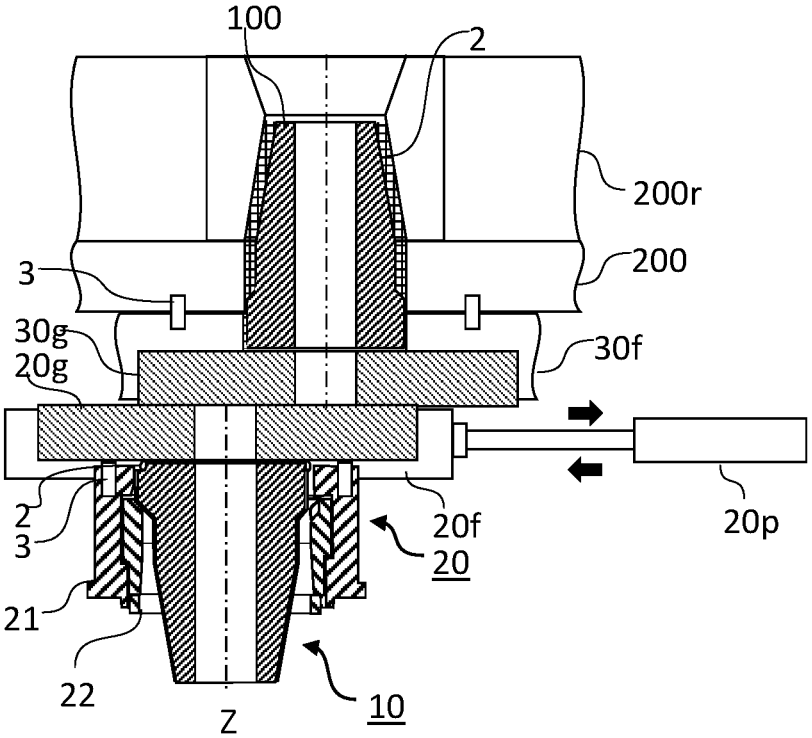
FIGS. 6A and 6B show a bottom plate assembly according to the present invention belonging to a two-plate gate.
Figure 6B:
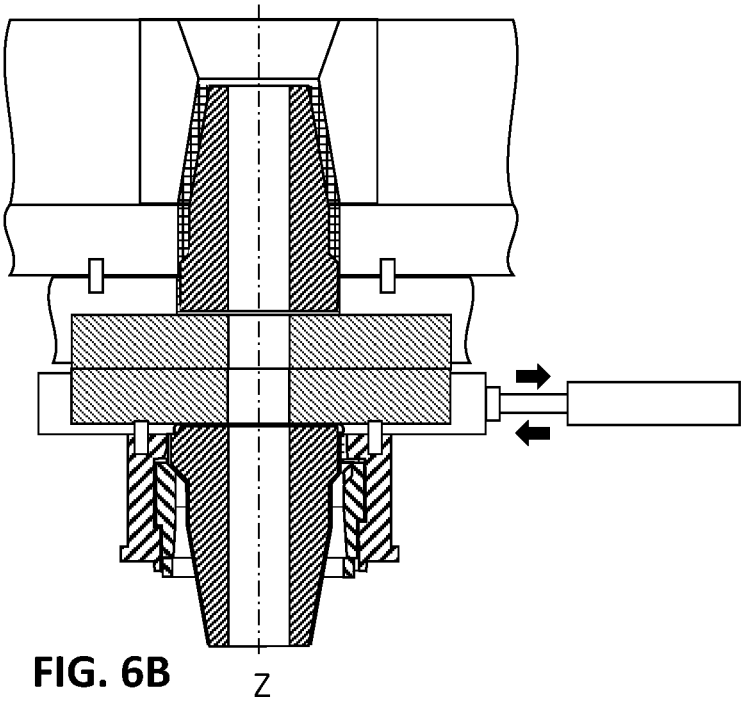

In a two-plate gate system as illustrated in FIGS. 6A and 6B, the bottom gate plate (20*g*) is provided with a bore and is coupled in sliding relationship by translation or rotation) to a top gate plate (30*g*) provided with a similar bore. The top gate plate (30*g*) is rigidly coupled to a top frame (30*f* which is itself rigidly coupled to the bottom of the ladle. The frame (20*f*) to which the bottom gate plate is rigidly coupled is a carriage which is mobile with respect to the top frame (30*f*). The movements of the carriage frame (20*f*) with respect to the top frame (300 are actuated by a pneumatic or hydraulic cylinder (20*p*) and/or an electric drive and allow sliding the bottom gate plate over the top gate plate (30*g*) such as to bring the bore of the gate plates in and out of registry, to open or close the gate (cf. FIGS. 6A and 6B).

As can be seen in FIGS. 6A and 6B, because in two-plate gates, the collector nozzle is coupled to a mobile carriage frame (20*f*), the ladle shroud, which is an elongated tube engaged over the collector nozzle and extending far below the ladle bottom (cf. FIG. 1A), moves with the carriage as the bottom gate plate is being operated to open or close the gate, to control the molten metal flow rate. In some applications, such movements of the ladle shroud are not acceptable. In order to operate a gate without moving the collector nozzle and the ladle shroud coupled thereto, a three-plate gate can be used instead.

Figure 7A:
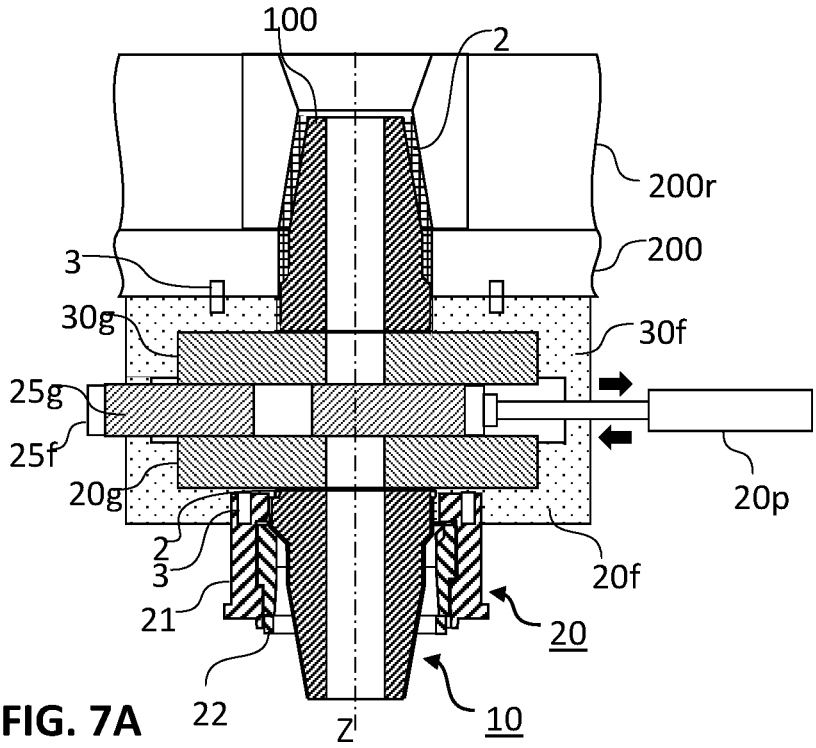
FIGS. 7A and 7B show a bottom plate assembly according to the present invention belonging to a three-plate gate.
Figure 7B:
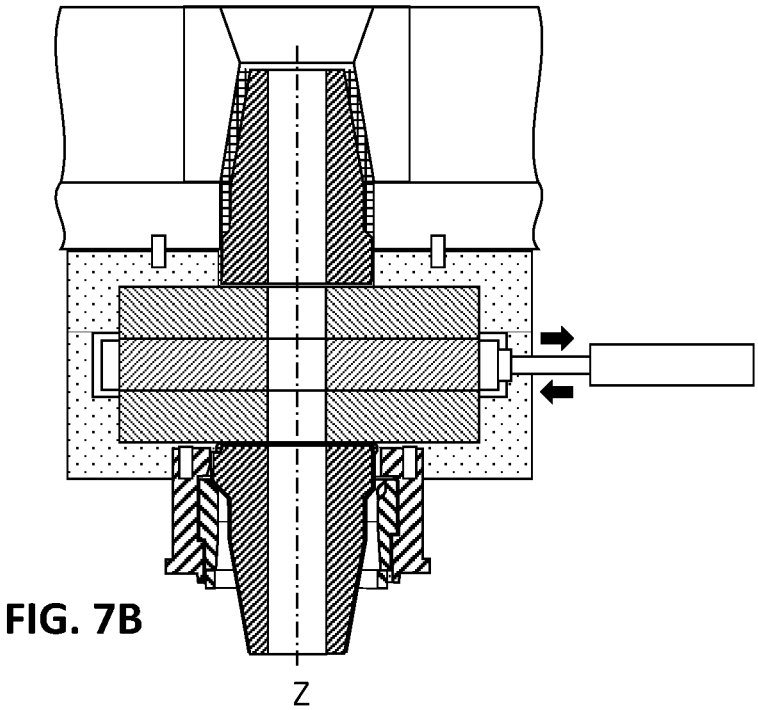

A three-gate plate is illustrated in FIGS. 7A and 7B. Contrary to a two-gate plate, in a three gate-plate the bottom gate plate (20*g*) to which the collector nozzle is coupled is fixed with respect to the top gate plate (30*g*) and to the ladle outlet. The frame (200 is either rigidly fixed to, or forms a single structure with, the top frame (300. The flow rate of molten metal is controlled by moving a mid-gate plate (25*g*) sandwiched between the bottom and top gate plates. The mid-gate plate (25*g*) is provided with a bore similar to the bores of the bottom and top gate plates. By moving the mid-gate plate with respect to the bottom and top gate plates, the bore of the mid-gate plate is brought in or out of registry with respect to the bores of the bottom and top gate plates. This way, the flow rate of molten metal can be controlled without moving the collector nozzle (10) and the ladle shroud (111) coupled thereto.

The description above focused on a collector nozzle coupled to a ladle (200L), for coupling a ladle shroud (111). It is clear that the same applies mutatis mutandis to a collector nozzle coupled to a tundish (200T) for coupling a pouring nozzle (101), or to any metallurgic vessel provided with a nozzle to be coupled thereto.

Various features and characteristics of the invention are described in this specification and illustrated in the drawings to provide an overall understanding of the invention. It is understood that the various features and characteristics described in this specification and illustrated in the drawings can be combined in any operable manner regardless of whether such features and characteristics are expressly described or illustrated in combination in this specification. The Inventor and the Applicant expressly intend such combinations of features and characteristics to be included within the scope of this specification, and further intend the claiming of such combinations of features and characteristics to not add new matter to the application. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new matter to the specification or claims and will comply with the written description requirement under 35 U.S.C. § 112(a). The invention described in this specification can comprise, consist of, or consist essentially of the various features and characteristics described in this specification.

| Ref. # | Feature |
|---|---|
| 1 | Molten metal |
| 2 | Sealing material |
| 3 | Rigid fixation |
| 10 | Collector nozzle |
| 10b | Collector nozzle bore |
| 10c | Can |
| 10d | Collector nozzle downstream surface |
| 10L | Collector nozzle lateral surface |
| 10u | Collector nozzle upstream surface |
| 11 | Protrusion |
| 11d | Protrusion lower surface |
| 11u | Protrusion upper surface |
| 20 | Nozzle coupling unit |
| 20f | Frame |
| 20g | Lower gate plate |
| 20p | Hydraulic piston |
| 21 | Nozzle receiving bushing |
| 21b | Blocking stop of bayonet ring rotation |
| 21d | Downstream portion of the nozzle receiving bushing |
| 21m | Protrusion mating structure |

-continued

| Ref. # | Feature |
|---|---|
| 21t | Thread of nozzle receiving bushing |
| 21u | Upstream portion of the nozzle receiving bushing |
| 22 | Bayonet ring |
| 22b | Rotation blocking stop |
| 22c | Channel for receiving protrusions |
| 22d | Downstream edge of the bayonet ring |
| 22r | Rotation gripping means or rotation gripper |
| 22t | Thread of bayonet ring |
| 22u | Upstream edge of the bayonet ring |
| 25f | Carriage supporting mid-gate plate 25 g |
| 25g | Mid-gate plate in a 3-plate gate |
| 30f | Upper frame |
| 30g | Upper gate plate |
| 100 | Inner nozzle |
| 101 | Pouring nozzle |
| 111 | Ladle shroud |
| 200 | Metallurgic vessel |
| 200L | Ladle |
| 200r | Refractory lining of the Metallurgic vessel |
| 200T | Tundish |
| 211 | Robot |
| W | Protrusion width (maximum) |
| Wd | Channel width adjacent the downstream edge |
| Wu | Channel width adjacent the upstream edge |
| Z | Longitudinal axis |

What is claimed is:

1. A casting assembly comprising: (A) a collector nozzle comprising: (a) an upstream surface and a downstream surface joined to one another by a lateral surface, and comprising a bore extending along a longitudinal axis (Z) from the upstream surface to the downstream surface, (b) N protrusions, wherein N≥2, distributed around a perimeter of the lateral surface, each protrusion comprising an upper surface which is adjacent to the upstream surface of the collector nozzle and a lower surface separated from the upper surface by a height of the protrusion, and having an azimuthal width (W) measured normal to the longitudinal axis (Z), (B) a frame comprising a gate plate receiving unit for receiving a lower gate plate, and (C) a nozzle coupling unit for receiving and rigidly coupling the collector nozzle to the frame, said nozzle coupling unit comprising a nozzle receiving bushing rigidly fixed to the frame, wherein, the nozzle coupling unit further comprises a bayonet ring comprising an upstream edge and a downstream edge separated by a height of the bayonet ring, which is permanently and rotatably mounted in the nozzle receiving bushing such that the bayonet ring can rotate about the longitudinal axis (Z) and wherein the bayonet ring comprises an inner surface provided with N channels extending along the longitudinal axis (Z) from the downstream edge to the upstream edge, wherein the N channels have a downstream width (Wd) at the level of the downstream edge which is larger than the azimuthal width (W) of the protrusions, allowing the translation along the longitudinal axis (Z) of the collector nozzle through the downstream edge of the bayonet ring with the protrusions engaged in corresponding channels until they contact and mate with mating structures of the corresponding protrusion, and wherein the N channels have an upstream width (Wu) at the level of the upstream edge which is larger than the downstream width (Wd), the N channels thus being configured to allow the rotation of the bayonet ring about the longitudinal axis (Z) with respect to the collector nozzle until an edge of the channel contacts the lower surface of the corresponding protrusion, thus locking the collector nozzle in an operating position.

2. The assembly according to claim 1, wherein N comprises a value selected from the group consisting of 3 and 4, and wherein the N protrusions are distributed evenly around the perimeter of the lateral surface.

3. The assembly according to claim 1, wherein the N channels extend from the downstream edge over at least 40% of the height of the bayonet ring with a constant width (Wd) and widen until reaching the width (Wu) at the upstream edge.

4. The assembly according to claim 1, wherein the bayonet ring comprises an outer surface provided with a thread mating a thread provided at an inner surface of the nozzle receiving bushing, the bayonet ring being configured such that rotation of the bayonet ring with respect to the nozzle receiving bushing translates the bayonet ring along the longitudinal axis (Z).

5. The assembly according to claim 1, wherein the nozzle receiving bushing comprises protrusion mating structures configured to receive the protrusions and preventing the collector nozzle from rotating about the longitudinal axis, Z.

6. The assembly according to claim 5, wherein the bayonet ring comprises an outer surface provided with a rotation stop, and wherein the nozzle receiving bushing comprises a corresponding rotation stop provided at an inner surface of the nozzle receiving bushing, which stops rotation of the bayonet ring when the channels of the bayonet ring face the protrusion mating structures of the nozzle receiving bushing.

7. The assembly according to claim 1, wherein the nozzle receiving bushing is formed of an upstream portion rigidly fixed to the frame, and of a downstream portion coupled to the upstream portion and sandwiching the bayonet ring, configured to allow rotation of the bayonet ring with respect to the nozzle receiving bushing, but not extraction of the bayonet ring from the nozzle receiving bushing.

8. The assembly according to claim 1, wherein the downstream edge of the bayonet ring comprises a rotation gripper, configured to allow the insertion of a tool for rotating the bayonet ring about the longitudinal axis (Z).

9. The assembly according to claim 1, wherein the frame is selected from the group consisting of: (a) a mobile carriage in a two-plate gate, and (b) a fixed frame in a three-plate gate.

10. The assembly according to claim 1, which is part of a gate system mounted at a bottom of a metallurgic vessel.

11. A method for mounting a collector nozzle onto a gate system, said method comprising the following steps: (a) providing a bottom plate assembly according to claim 1, (b) engaging the upstream surface of the collector nozzle through the bayonet ring from the downstream edge, with the N protrusions engaged in the corresponding channels, (c) inserting the collector nozzle along the longitudinal axis (Z) through the bayonet ring all the way until the collector nozzle reaches an operating position, and (d) rotating the bayonet ring about the longitudinal axis (Z) with respect to the collector nozzle until the collector nozzle is locked into its operating position and cannot move along the longitudinal axis (Z).

12. The method according to claim 11, wherein the nozzle receiving bushing comprises protrusion mating structures configured to receive the protrusions and preventing the collector nozzle from rotating about the longitudinal axis, Z, the method comprising the step of positioning the channels of the bayonet ring face to face with the corresponding nozzle mating structures of the nozzle receiving bushing, prior to step (c) of inserting the collector nozzle along the longitudinal axis (Z) through the bayonet ring all the way until the collector nozzle reaches its operating position with the protrusions engaged in the nozzle mating structures and thus prevented from rotating with respect to the longitudinal axis (Z).

13. The method according to claim 11, wherein prior to engaging the collector nozzle through the bayonet ring in step (c), a bottom gate plate is positioned into the gate plate receiving unit and is rigidly coupled to the frame, a refractory sealing material is applied onto the upstream surface of the collector nozzle, such that when the collector nozzle reaches its operating position in step (d), the sealing material contacts a downstream surface of the bottom gate plate.

14. The method according to claim 11, wherein at least one of the steps of claim 11 is carried out by a robot.

15. The assembly according to claim 1, wherein Wd is at least 1% larger than W to allow for movement of the protrusions along the N channels.

16. The assembly according to claim 1, wherein Wd is between 5% and 10% larger than W to allow for guidance of the protrusions.

* * * * *